United States Patent [19]

Harvey et al.

[11] Patent Number: 4,642,522

[45] Date of Patent: Feb. 10, 1987

[54] WIRE-ION-PLASMA ELECTRON GUN EMPLOYING AUXILIARY GRID

[75] Inventors: Robin J. Harvey, Thousand Oaks; Hayden E. Gallagher, Malibu; Robert W. Schumacher, Canoga Park, all of Calif.

[73] Assignee: Hughes Aircraft Company, Los Angeles, Calif.

[21] Appl. No.: 621,420

[22] Filed: Jun. 18, 1984

[51] Int. Cl.[4] ..... H01J 7/24

[52] U.S. Cl. ..... 315/111.31; 313/231.31; 313/360.1; 315/111.81; 315/111.91

[58] Field of Search ..... 315/111.71, 111.31, 315/111.91, 111.81, 337, 340; 313/360.1, 231.31; 328/76, 64, 229

[56] References Cited

U.S. PATENT DOCUMENTS 3,970,892 7/1976 Wakalopulos ..... 315/111.31
4,025,818 5/1977 Giguere et al. ..... 315/337
4,458,180 7/1984 Sohval et al. ..... 315/111.81

FOREIGN PATENT DOCUMENTS 671681 5/1980 U.S.S.R. ..... 315/111.71

*Primary Examiner*—Saxfield Chatmon
*Attorney, Agent, or Firm*—Anthony W. Karambelas

[57] ABSTRACT

An improved Wire-Ion-Plasma Electron-gun (WIP E-gun) is disclosed, having a very rapid electron beam current interruption capability. An auxiliary grid is employed to provide a potential barrier to the reservoir of plasma ions in the ionization chamber, thereby containing these ions in the chamber after the wire anode is turned "OFF". The E-gun current fall time is reduced to the time required for the plasma potential to fall in the ionization chamber after the wire anode is turned "OFF". The WIP E-gun current fall time is reduced, from greater than fifteen microseconds for devices not employing the invention, to less than two microseconds.

7 Claims, 10 Drawing Figures

WIRE-ION-PLASMA ELECTRON GUN EMPLOYING AUXILIARY GRID

BACKGROUND OF THE INVENTION

The present invention relates to plasma source devices known as Wire-Ion-Plasma (WIP) electron guns.

WIP electron guns are known in the art and comprise high voltage discharge power sources used to drive gas-discharge lasers and to control high-pressure switching devices. An exemplary U.S. Patent disclosing a WIP E-gun is U.S. Pat. No. 4,025,818 entitled "Wire Ion Plasma Gun", issued to Giguere et al. and assigned to Hughes Aircraft Company. In addition, U.S. Pat. No. 3,970,892 entitled "Ion Plasma Electron Gun", issued to Wakalopulos and assigned to Hughes Aircraft discloses an ion plasma electron gun. Advantages of the WIP E-gun include the facts that no cathode heater power is required, instant start is provided, the controlling signal is obtained from a pulser at ground potential, and the WIP E-gun is not sensitive to poisoning by exposure to air or the switch gases. The WIP E-gun does require a source of low pressure gas, typically helium.

A disadvantage of known WIP E-guns has been the slow fall time (greater than fifteen microseconds) of the tail on the electron-beam current pulse. This has limited the usefulness of WIP E-guns in applications such as gas discharge laser pumping and electron beam controlled switching, which require a beam which turns "OFF" or interrupts in a time of less than a few microseconds. By way of example only, an electron-beam-controlled switch marketed by the assignee of the present invention employs a WIP E-gun which is the controlling element for the switch. This WIP E-gun has been characterized by a beam current fall time which increases with beam pulse length, reaching about fifteen microseconds following beam pulses of 10 to 100 microseconds in duration.

It is, therefore, an object of the present invention to provide an improvement in the pulse-shaping capability of WIP E-guns, especially for pulses of duration in excess of 10 microseconds.

It is another object of the present invention to provide a WIP E-gun having a reduced beam current fall time.

A further object of the invention is to identify the cause of the tail on the current pulse from a WIP E-gun, and provide a means for eliminating this tail.

Yet another object of the present invention is to provide a WIP E-gun employing an auxiliary grid adapted to significantly reduce the fall time of the current pulse.

SUMMARY OF THE INVENTION

A WIP E-gun adapted for rapid interruption of the beam current is disclosed. The adapted E-gun employs a means for containing the reservoir of ions within the ionization chamber at the end of the pulse until the plasma has decayed. In the preferred embodiment, this comprises an auxiliary grid between the ionization chamber grid and the E-gun cathode. The auxiliary grid is biased above the potential of the ionization chamber grid so that, once the wire voltage is "turned-off" and the plasma potential falls, ions passing through the chamber grid no longer have enough kinetic energy to overcome the potential barrier created by the auxiliary grid. As the plasma decays, ions are therefore prevented from leaking into the E-gun gap and the E-gun current fall time is thereby reduced to the time required for the plasma potential to fall in the ionization chamber.

Other features and improvements are disclosed.

BRIEF DESCRIPTION OF THE DRAWINGS

These and other features and advantages of the present invention will become more apparent from the following detailed description of an exemplary embodiment thereof, as illustrated in the accompanying drawing, in which.

DETAILED DESCRIPTION OF THE INVENTION

The present invention comprises a novel Wire-Ion-Plasma Electron gun (WIP E-gun) adapted for fast turn-off of the ion source. The following description is presented to enable any person skilled in the art to make and use the invention, and is provided in the context of a particular application and requirements. Various modifications to the preferred embodiment will be readily apparent to those skilled in the art, and the generic principles defined herein may be applied to other embodiments and applications. Thus, the present invention is not intended to be limited to the embodiment shown, but is to be accorded the widest scope consistent with the principles and novel features disclosed herein.

Figure 1:
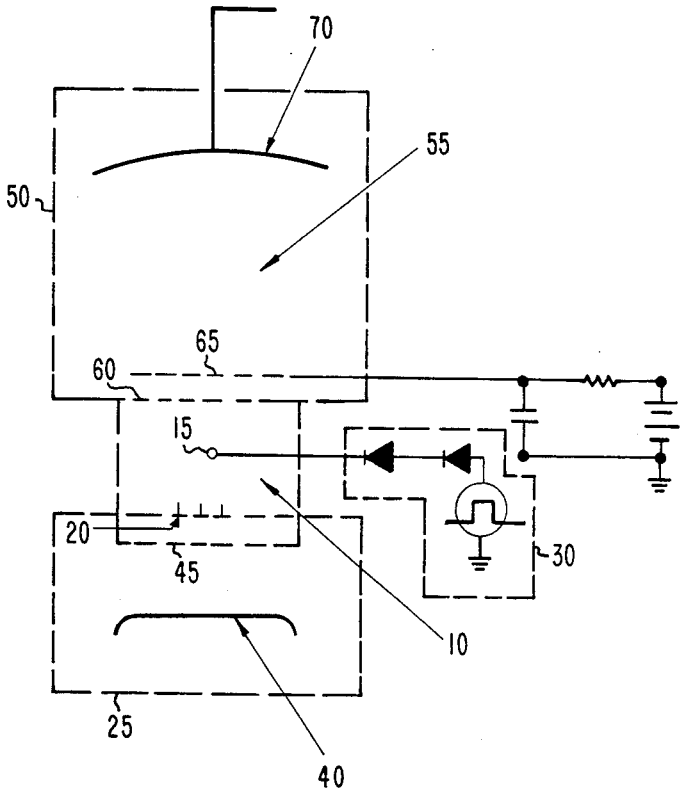
FIG. 1 is a schematic view of a WIP E-gun employing the present invention used in a Electron-Beam Controlled Switch.

One embodiment of this invention is shown in FIG. 1. Here the WIP E-gun employing the invention is used in an Electron-Beam Controlled Switch (EBCS). Other possible applications for this invention include Free Electron Lasers (FEL), Gas Lasers, Gyrotrons and other similar devices requiring a pulsed electron source with a fast rise and fall pulse shape.

In the EBCS shown in FIG. 1, the WIP E-gun operates in the following manner. The ionization chamber 10 is filled with a gas at low pressure—typically helium at 20 mTorr. A positive voltage pulse (in the range of 500–2000 volts) applied to the wire anode 15 by pulse circuit 30 initiates ionization of the He atoms by the fast electrons trapped around the fine wire anode 15. Once started, e.g., ionization of the He atoms in the ionization chamber 10, the plasma is sustained by a voltage (in the range of 200–500 volts) applied to the fine wire anode 15. He ions are extracted from the ionization chamber 10 through the ionization chamber grid (first grid 60) and accelerated by a high voltage (150 kV) into the wire-ion-plasma (WIP) electron-gun 50, where the ions impact the E-gun cathode 70 and cause electrons to be emitted by secondary emission. The emitted electrons are accelerated by the 150 kV E-gun gap 55 and pass through the ionization chamber to a foil 20 which separates the switch cavity 25 from the WIP E-gun. The high velocity (150 keV) electrons penetrate the foil, enter the switch cavity, and ionize the switch gas (typically methane at 4 atmospheres) causing switch closure or conduction of the discharge current between the switch cathode 40 and anode 45.

Figure 2:
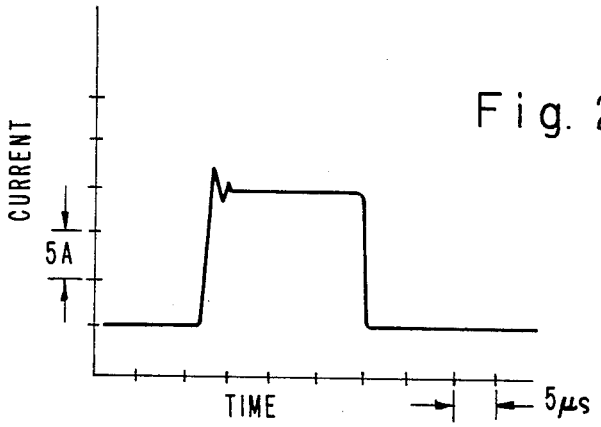
FIG. 2 is a graph plotting the wire-anode current pulse waveform of a WIP E-gun.

A required EBCS characteristic is that the switch turn "ON" and turn "OFF" rapidly, e.g., in a few microseconds or less. The fast turn "OFF" is the difficult requirement to meet. This requirement means that, in turn, the wire anode current and electron beam current pulses must also be characterized with a sharp decay, i.e., less than a few microseconds. Typical wire-anode current pulse waveforms are illustrated in FIG. 2 for WIP E-guns which do not employ the present invention. It is noted that a fast anode current fall time is achieved. However, the resulting electron-beam current pulse waveform, illustrated in FIG. 3, has a long fall time of greater than fifteen microseconds. The long fall time is most evident following pulses lasting several microseconds.

Aspects of the present invention include the identification of the cause of the tail on the current pulse from a WIP E-gun, and the development of a grid suitable for eliminating this tail. It is noted from FIG. 3 that, at the end of the current pulse the amplitude increases by approximately 50% and then decays exponentially. This phenomena is caused by the collapse of the Child-Langmuir ion-space-charge-limited sheath at the surface of the grid 60 through which ions are extracted into the E-gun gap as the wire-anode pulse is abruptly terminated.

Figure 4:
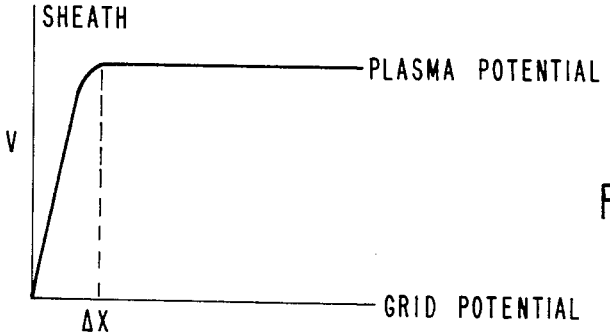
FIG. 4 is a graph plotting the plasma potential as a function of distance from the grid, illustrating the Child-Langmuir sheath theory.

This phenomenon may be understood by examining the details of the sheath in this region. As shown in FIG. 4, the E-gun plasma potential of typically 200–500 volts falls across the sheath over a distance ΔX to the grid at ground potential. The size of the sheath ΔX, is determined by the voltage and the ion current density J as described by the Child-Langmuir theory.

$$J = \frac{4}{9}\,\epsilon o\sqrt{\frac{2e}{m_i}}\;\frac{V^{1.5}}{(\Delta X)2} = K\frac{V^{1.5}}{(\Delta x)2} \qquad (1)$$

where $K = 2.73 \times 10^{-8}$ (Helium ions).

Figure 3:
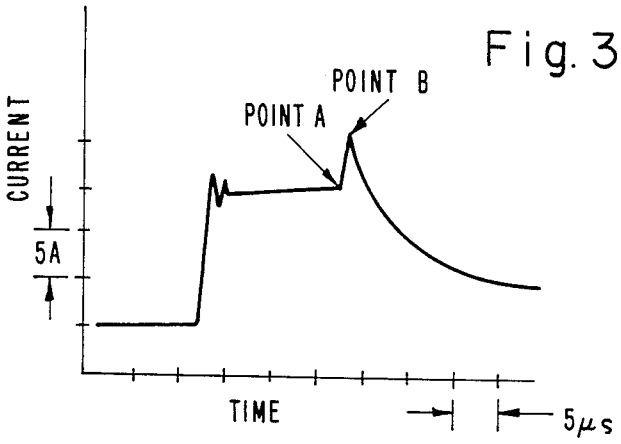
FIG. 3 is a graph plotting the waveform of the electron beam current of a prior art WIP E-gun, demonstrating the relatively long fall or turn-off time of the current.
Figure 5A:
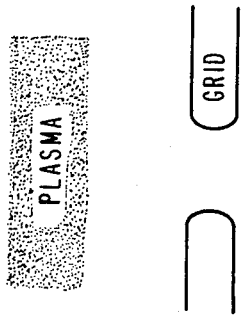
FIG. 5 (*a*) and 5 (*b*) are simplified depictions of the sheaths formed around the grid for two plasma potentials, 200 volts (or above) and about 5 volts.
Figure 5B:
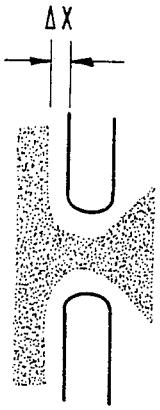

For a given current density, the grid aperture size is chosen such that the sheath is large compared to the radius of the apertures formed in grid 60, as shown in FIG. 5 (*a*), so that while single ions can be accelerated through the grid, the bulk plasma cannot pass directly through the grid holes. However, when the wire-anode is abruptly "turned-off," the cold cathode discharge is terminated and the 200-V plasma potential falls (on the same time scale as the wire voltage) to just a few volts above the potential of grid 60 as the electrons and ions in the afterglow plasma now drift to the walls of the ionization chamber 10. The plasma decay time is much longer than the wire-voltage fall time because of ion inertia. This decay time is characteristically, $$\tau = \frac{L}{v_i} = \frac{L}{(T_e/m_i)^{\frac{1}{2}}} \qquad (2)$$

where $v_i$ is the ion sound speed and L is the length of the ionization chamber 10. For helium ions and $T_e$ of about 1 eV, this time is typically fifteen microseconds. If the wire-anode pulse is terminated in less than one microsecond (FIG. 2), then, since the plasma takes much longer to decay, the ion current density J will remain practically unchanged while the plasma potential falls to near the grid potential. Equation (1) predicts that, under these circumstances Δx will shrink substantially, which, in the extreme leads to plasma penetration through the individual grid apertures as shown in FIG. 5 (*b*). This phenomena allows the ion flux to the E-gun cathode to increase which, in turn, increases the electron-beam current. The increase in electron-beam current is illustrated in FIG. 3 as an increase from point A to point B. Then the current decays from point B of FIG. 3, on the plasma decay time scale of fifteen microseconds, and thus gives rise to the long, fifteen microsecond beam current tail.

Figure 6A:
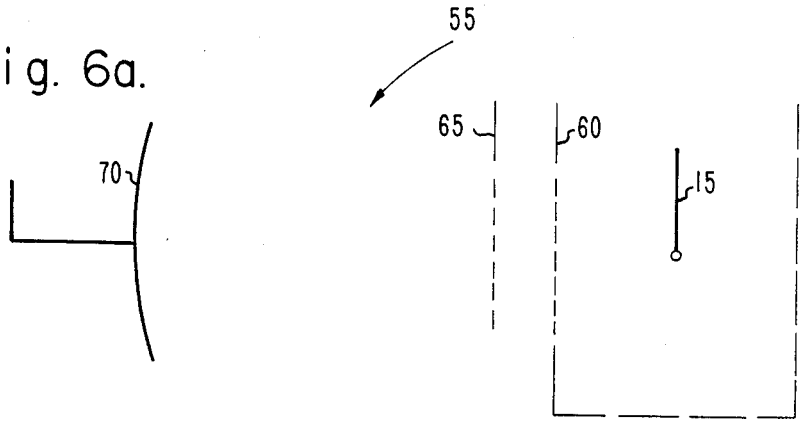
FIG. 6 (*a*) illustrates a simplified schematic of the present invention while FIGS. 6 (*b*) and 6 (*c*) illustrate the potential distribution along an axial dimension of the WIP E-gun without the auxiliary grid of the present invention (FIG. 6 (*b*)) and with the auxiliary grid (FIG. 6 (*c*)).
Figure 6B:
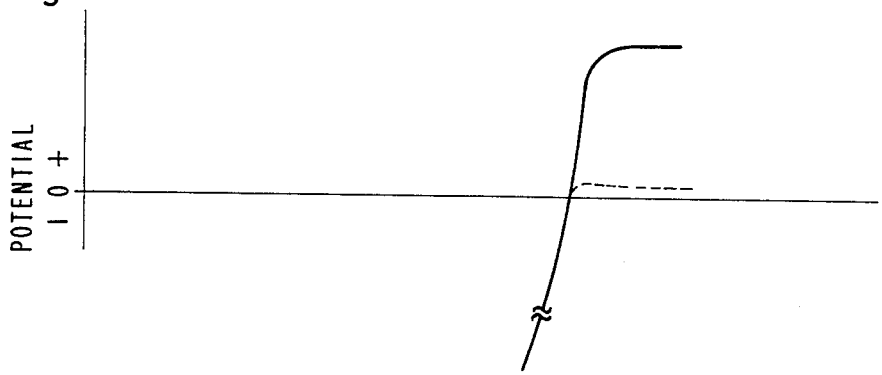
Figure 6C:
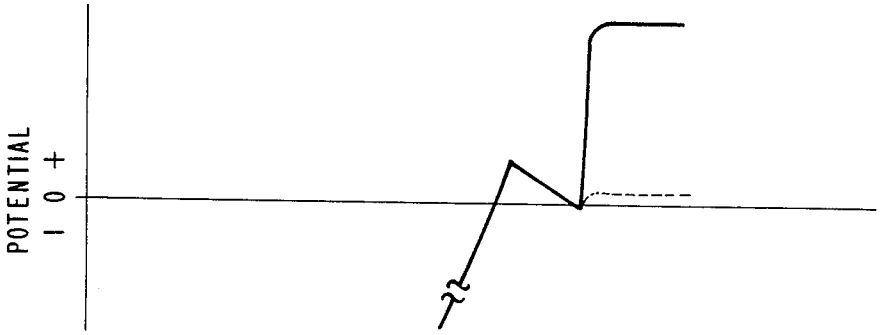

The present invention comprises the addition of an auxiliary grid (second grid 65) as shown in the simplified schematic of FIG. 6 (*a*). Without the second grid 65 of the present invention, the potential distribution from the E-gun cathode 70 to the wire anode 15 during conduction is illustrated by the solid line of FIG. 6 (*b*). When the wire anode voltage is turned "OFF", the plasma potential in the ionization chamber 10 falls to just a few volts above the first grid potential. The dashed line of FIG. 6 (*b*) represents the potential level to which the ionization chamber plasma potential falls in relation to the first grid 60 and the E-gun gap 55. As the potential of the ionization chamber plasma falls, ions leak into the E-gun gap 55 causing an increase of electron-beam current as previously discussed.

However, in the present invention a second grid 65 is biased at about +40 volts above the first grid 60. With the first and second grid arrangement, ion flow to the E-gun cathode 70 is unaffected when the wire anode voltage is "ON" and the plasma potential is greater than or equal to 200 volts. During conduction, ions passing through the first grid 60 are accelerated to 200 eV and easily penetrate the second grid 65. The potential distribution from the E-gun cathode 70 to the wire anode 15 during conduction is illustrated by the solid line of FIG. 6 (*c*). The second grid 65 sets up a 40-volt potential barrier between the second grid 65 and the first grid 60. When the wire voltage is turned "OFF", the plasma potential in the ionization chamber 10 falls to about 5 volts. The dashed line of FIG. 6 (*c*) represents the potential level to which the ionization chamber plasma falls in relation to the first grid 60, second grid 65, and the E-gun gap 55. As the ionization chamber plasma potential falls, ions passing through the first grid 60 no longer have enough kinetic energy to overcome the 40-volt potential barrier at the second grid 65. As the plasma decays in the ionization chamber 10, ions are therefore prevented from leaking into the E-gun gap 55 and the E-gun current fall time is thereby reduced to the time reguired for the plasma potential to fall in the ionization chamber.

The use of two grids, rather than a single grid biased with respect to the walls of the ionization chamber, is necessitated by the need for isolation of any feedback from the biased grid. A single biased grid would act as an anode upon turn "OFF" of the wire anode voltage. Acting as an anode, the single biased grid would generate detrimental currents in the plasma resulting in an increase in the plasma potential. The increase in plasma potential would thus negate the desired potential barrier effect.

Figure 7:
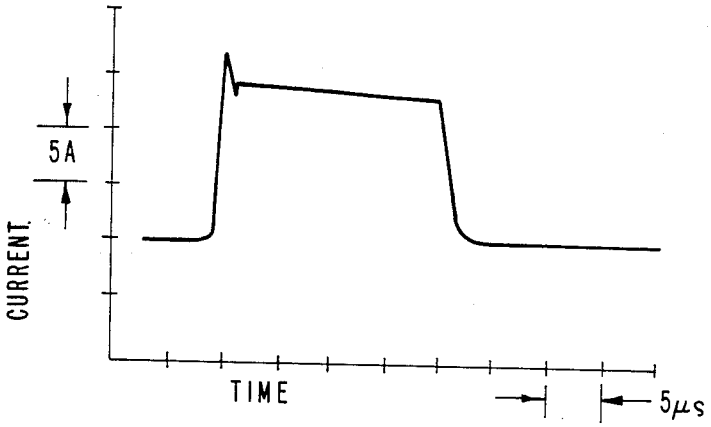
FIG. 7 is a graph illustrating the current pulse waveform of a WIP E-gun employing an auxiliary grid in accordance with the present invention, demonstrating the relatively fast turn-off capability.

The WIP E-gun current pulse obtained when using the auxiliary grid is shown in FIG. 7. The current fall time is now less than two microseconds whereas the fall time without the auxiliary grid was greater than fifteen microseconds. To obtain the increased fall time, it is preferred that a dc bias is applied to the auxilliary grid, rather than pulsing the auxilliary grid.

Both the ionization chamber grid (first grid 60) and auxiliary grid (second grid 65) must be dimensioned properly to achieve the desired objective of decreasing the length of the current-pulse tail. The grids were dimensioned using a combination of experimental and computational procedures. For the disclosed embodiment, from calculations of plasma sheath thicknesses for the plasma densities and current densities used, and from mechanical stability considerations a 0.6 cm spacing between grids 60 and 65 was selected. For the spacing between grid wires, 0.03 cm was selected for the ionization chamber grid, and 0.1 cm for the auxiliary grid. For these dimensions and the plasma parameters characteristic of the ionization chamber used with the EBCS, the auxiliary grid voltage was varied experimentally from 0 to +150 volts, and the setting for optimum current tail shape was found to be +40 volts.

It will be apparent to those skilled in the art that there are a number of combinations of dimensions for grids that are suitable for eliminating the tail on the current pulse. However, one facet of the invention is the recognition that the source of ions causing the tail is the reservoir of ions in the ionization chamber. The objective to be fulfilled in accordance with the invention is to contain these ions within the chamber at the end of the pulse with the auxiliary grid until the plasma has decayed.

It is understood that the above-described embodiment is merely illustrative of the many possible specific embodiments which can represent principles of the present invention. Numerous and varied other arrangements can readily be devised in accordance with these principles by those skilled in the art without departing from the spirit and scope of the invention.

What is claimed is:

1. An electron-ion plasma source, comprising:

an ionization chamber containing a gas;

an anode disposed in said ionization chamber for ionizing said gas upon application of an ionization potential thereto;

a cathode separated from said ionization chamber by a gap;

means for providing a high potential difference between said anode and said cathode such that ions are extracted from said chamber into said gap and accelerated through said potential difference to bombard said cathode, thereby producing electrons by secondary emission which are in turn accelerated through said potential difference to provide high energy electrons;

first grid means disposed between said ionization chamber and said gap;

second grid means disposed between said first grid means and said cathode in said gap; and means for providing a potential to said second grid means, whereby upon interruption of said ionization potential to said anode, ions passing through said first grid means do not have sufficient kinetic energy to overcome the potential barrier of said second grid means and are thereby prevented from being accelerated through said potential difference.

2. The plasma source of claim 1 wherein said second grid means is biased above the potential of said ionization chamber when the ionization potential to said anode is interrupted.

3. The plasma source of claim 2 wherein said second grid is biased about 40 volts above the potential of said ionization chamber.

4. The plasma source of claim 2 wherein said first and second grid means and said means for providing a potential to said second grid means are cooperatively adapted such that, once the ionization potential is interrupted and as the plasma in the ionization chamber decays, ions are prevented from leaking into said gap.

5. The plasma source of claim 4 wherein the dimensions of said first and second grid means are determined in dependence upon the plasma densities and current densities for such plasma source.

6. The plasma source of claim 5 wherein said means for providing a potential to said second grid means is adapted to optimize the current pulse shape of said plasma source.

7. An electron gun for selective generation and rapid extinguishment of a beam of high energy electrons, comprising:

an ionization chamber containing a gas;

a wire anode disposed in said ionization chamber for ionizing said gas and sustaining a plasma discharge within said gas upon application of an ionization potential thereto;

a cathode separated from said ionization chamber by a gap;

means for providing a high potential difference across said gap, such that positive ions which are extracted from said chamber into said gap are accelerated through said high potential difference to bombard said cathode, thereby producing electrons by secondary emission which are in turn accelerated through said potential difference to provide a beam of high energy electrons;

a first grid structure disposed between said ionization chamber and said gap;

a second grid structure disposed in said gap between said first grid structure and said cathode; and means for biasing said second grid structure above the potential of said first grid structure such that upon interruption of said ionization potential to said wire anode, positive ions comprising the reservoir of ions remaining in the ionization chamber and passing through said first grid do not have sufficient kinetic energy to overcome the potential barrier of said second grid structure, thereby rapidly extinguishing said electron beam.

* * * * *